US005347786A

United States Patent [19]

Hodges

[11] Patent Number: 5,347,786

[45] Date of Patent: Sep. 20, 1994

[54] REUSABLE CONCRETE SPACER SLEEVE

[75] Inventor: B. Eugene Hodges, Greenville, Mich.

[73] Assignee: James Bruno, Ada, Mich.

[21] Appl. No.: 969,717

[22] Filed: Oct. 7, 1992

[51] Int. Cl.[5] ..... B28B 7/16

[52] U.S. Cl. ..... 52/577; 249/142; 249/177; 264/31; 264/264

[58] Field of Search ..... 52/576, 577; 411/301, 411/437; 249/142, 151, 177; 264/31, 35, 264

[56] References Cited

U.S. PATENT DOCUMENTS

| | | | |
|---|---|---|---|
| 2,202,147 | 5/1940 | Gerriets | 52/99 |
| 2,212,974 | 8/1940 | Bateman | 249/177 |
| 2,270,286 | 1/1942 | Gerriets | 52/577 |
| 2,508,044 | 5/1950 | Seddon | 249/177 |
| 3,048,911 | 8/1962 | Almon | 249/177 X |
| 3,294,358 | 12/1966 | Hagedorn | 285/64 X |
| 3,469,817 | 9/1969 | Bowden et al. | 249/177 X |
| 3,800,486 | 4/1974 | Harvey | 52/577 X |
| 4,453,354 | 6/1984 | Harbeke | 52/220.8 |
| 4,623,170 | 11/1986 | Cornwall | 249/177 X |
| 4,625,940 | 12/1986 | Barton | 52/577 X |
| 4,804,160 | 2/1989 | Harbeke | 249/177 X |
| 4,823,527 | 4/1989 | Harbeke | 249/177 X |
| 4,951,914 | 8/1990 | Meyers et al. | 249/177 X |

FOREIGN PATENT DOCUMENTS

| | | | |
|---|---|---|---|
| 464599 | 7/1972 | Australia | 249/177 |
| 2241212 | 3/1975 | France | 411/437 |

*Primary Examiner*—Lloyd A. Gall
*Attorney, Agent, or Firm*—Bullwinkel Partners, Ltd.

[57] ABSTRACT

A reusable concrete spacer sleeve comprises a substantially cylindrical body having a plurality of inwardly extending fins. The sleeve is placed over a vertical drain pipe prior to pouring a concrete floor. After the concrete has set, the sleeve is removed, leaving an annular space around the pipe for accommodating a flange. A lid may be fitted onto the sleeve to prevent debris or other foreign matter from entering the pipe or the annular space around the pipe.

5 Claims, 2 Drawing Sheets

REUSABLE CONCRETE SPACER SLEEVE

BACKGROUND OF THE INVENTION

This invention relates to the plumbing trade, and in particular to an improved apparatus and method for finishing a drain pipe so as to bring it even with the level of a poured concrete floor.

In residential and commercial construction, drain pipes are used to direct wastes from a sink or toilet into the sewer below. Where a concrete floor is used, vertical drain pipes are installed prior to the pouring of the concrete floor. After the concrete floor has been poured, the drain pipe usually extends several inches or more above the level of the concrete floor. It then becomes necessary to reduce the level of the drain pipe to bring it even with the floor.

The conventional method for bringing a drain pipe even with a concrete floor is difficult and time consuming. First, concrete is chiseled out from around the pipe to expose part of the pipe below floor level. Next, the pipe is cut off below floor level. Finally, a glued closet fitting is attached to the end of the pipe so as to bring the pipe level with the level of the concrete floor.

While this method has been used in the past, there exists a need for an easier and less time consuming way to finish a drain pipe so as to bring it even with the level of a concrete floor.

SUMMARY OF THE INVENTION

It is therefore a principal object of the invention to provide an improved apparatus and method for bringing the level of a drain pipe even with the level of a concrete floor. A related objective is to provide a reusable concrete spacer sleeve which can be placed over the drain pipe before the concrete is poured and removed after the concrete is set, leaving a space around the drain pipe for accommodating a flange.

It is a further object of the invention to provide a method for leaving a space around a drain pipe after the concrete is poured and set without having to chisel out the concrete around the circumference of the drain pipe.

It is a still further object of the invention to provide a reusable concrete spacer sleeve which can be installed and removed quickly and easily.

Yet another object of the invention is to provide a concrete spacer sleeve for use either with pipes having a top end below the expected top level of a poured concrete floor or with pipes extending above the concrete floor.

THE DRAWINGS

DETAILED DESCRIPTION OF THE INVENTION

In building construction, drain pipes are used to direct wastes from a sink or toilet into the sewer below. Where a concrete floor is involved, the drain pipe is installed prior to the pouring of the concrete floor. Typically, the drain pipe extends several inches above the level of the poured concrete floor. After the concrete floor has set, it is necessary to chisel out enough concrete around the perimeter of the pipe and cut off some of the pipe in order to install a flange. This procedure is costly and time consuming.

The present invention allows the pipe to be cut off below the floor level before the concrete is poured. The invention also eliminates the need to chisel away concrete from the perimeter of the drain pipe.

Figure 1:
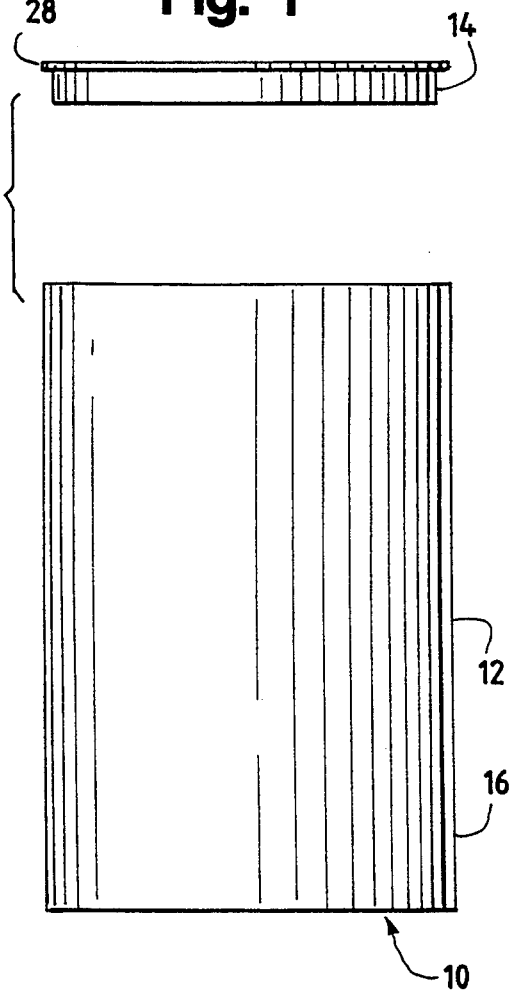
FIG. 1 is a front elevational view of a reusable concrete spacer sleeve with lid according to the present invention.
Figure 2:
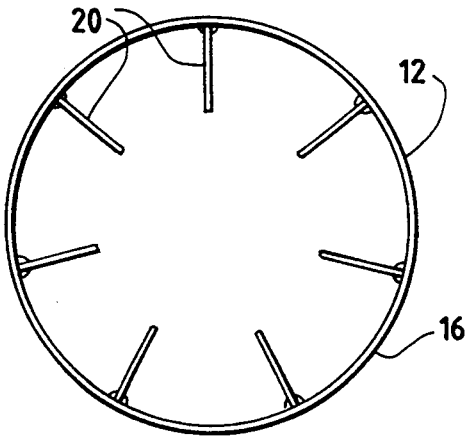
FIG. 2 is a top plan view of the reusable concrete spacer sleeve of FIG. 1 without the lid.
Figure 3:
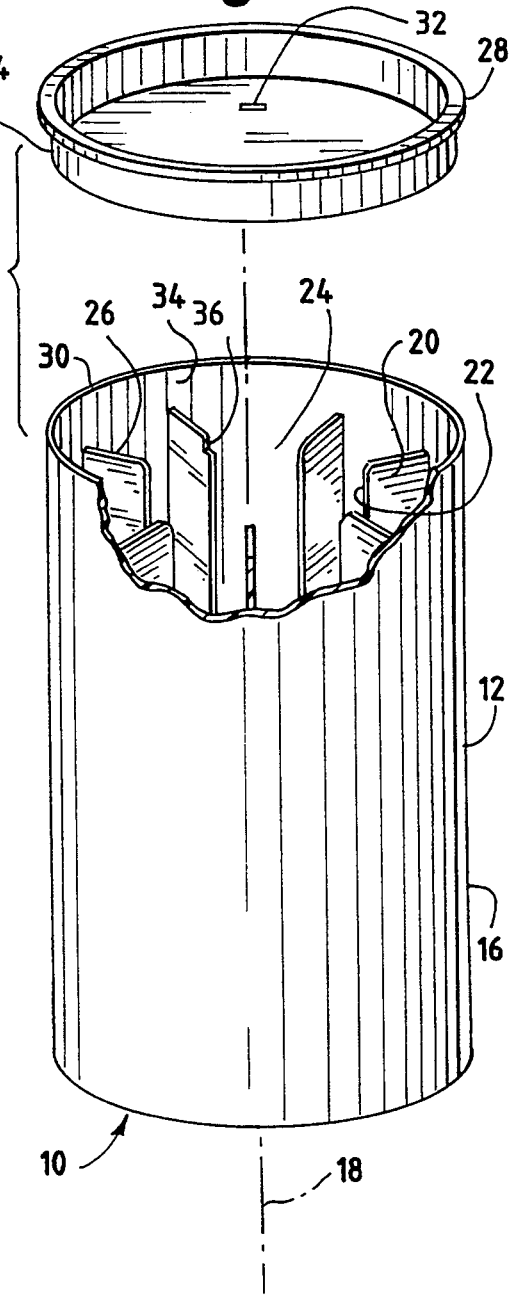
FIG. 3 is an exploded view of the reusable concrete spacer sleeve of FIG. 1.

Turning to the drawings, FIG. 1 illustrates a reusable concrete spacer sleeve according to the present invention. The concrete spacer sleeve 10 comprises a sleeve 12 and a lid 14. As best shown in FIGS. 2 and 3, the sleeve 12 comprises a substantially cylindrical body 16 defining a central axis 18 and a plurality of inwardly extending spacer elements 20 aligned in radial fashion with the central axis 18. The interior vertical edges 22 of the spacer elements 20 define a substantially cylindrical interior space 24 having a diameter slightly greater than the outside diameter of the drain pipe on which the sleeve will be placed so as to allow the sleeve 12 to fit snugly over the drain pipe, yet slide easily on and off. For example, in the case of three-inch schedule 30 P.V.C. or A.B.S. pipe having an outside diameter of 3.50 inches, the diameter of the interior space 24 should be slightly greater than 3.50 inches.

The body 16 extends a sufficient distance above the top ends 26 of the spacer elements 20 to allow room for the lid 14, if used. The lid 14 may be used to prevent debris, concrete or other foreign matter from entering either the drain pipe or the space between the pipe and the sleeve body 16. The lid 14 has a lip 28 which acts as a stop when the lid 14 is put on the sleeve 12 by engaging the upper rim 30 of the sleeve 12. The lip 28 also aids in removal of the lid 14 from the sleeve 12. In the preferred embodiment, a small opening 32 in the lid 14 allows air to pass through the lid 14.

In the preferred embodiment, the spacer elements 20 are finlike projections evenly spaced around the interior surface 34 of the sleeve 12. The spacer elements 20 position the sleeve 12 substantially symmetrically around the pipe. A notch 36, located at the juncture of the horizontal upper edge 26 and vertical interior edge 22 of each spacer element 20 facilitates the installation and removal of the sleeve 12.

Preferably, the concrete spacer sleeve 12 is formed of a flexible thermoplastic. The flexibility makes it easier to install and remove the sleeve 12.

The spacer sleeve 12 may be used with 3-inch schedule 30 P.V.C. or A.B.S. pipe, 3-inch schedule 40 P.V.C. or A.B.S. pipe, heavy duty cast iron pipe, service weight cast iron pipe, no hub cast iron pipe, or other suitable pipe.

Figure 4:
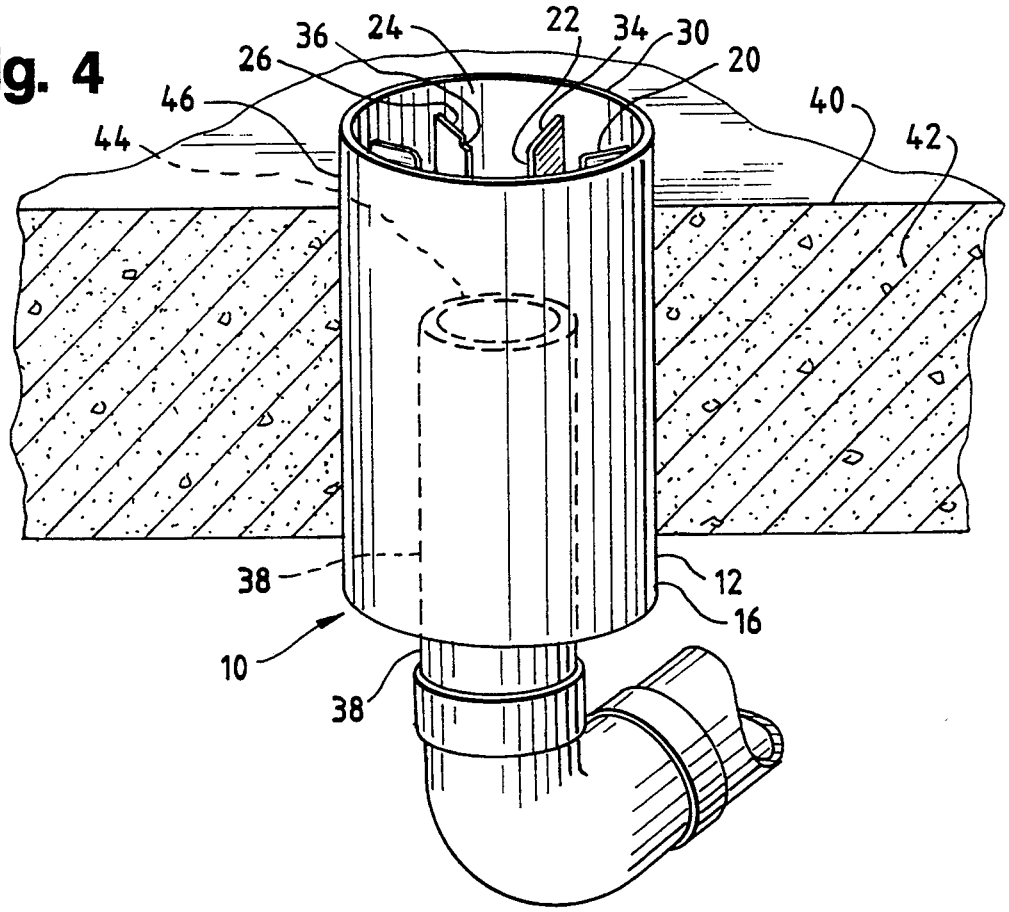
FIG. 4 is a perspective view of the reusable concrete spacer sleeve of FIG. 1 without the lid, shown fitted over a drain pipe.

FIG. 4 illustrates the reusable concrete spacer sleeve 10 of FIG. 1 without the lid 14, shown fitted over a drain pipe 38. The drain pipe 38 is shown cut off several inches below the top level 40 of the poured concrete floor 42. The sleeve 12 fits snugly around the pipe 38 and extends below the concrete floor 42. When the concrete floor 42 has set, the sleeve 12 can easily be removed, leaving a cylindrical space around the pipe 38 for accommodating a flange (not shown).

Figure 5:
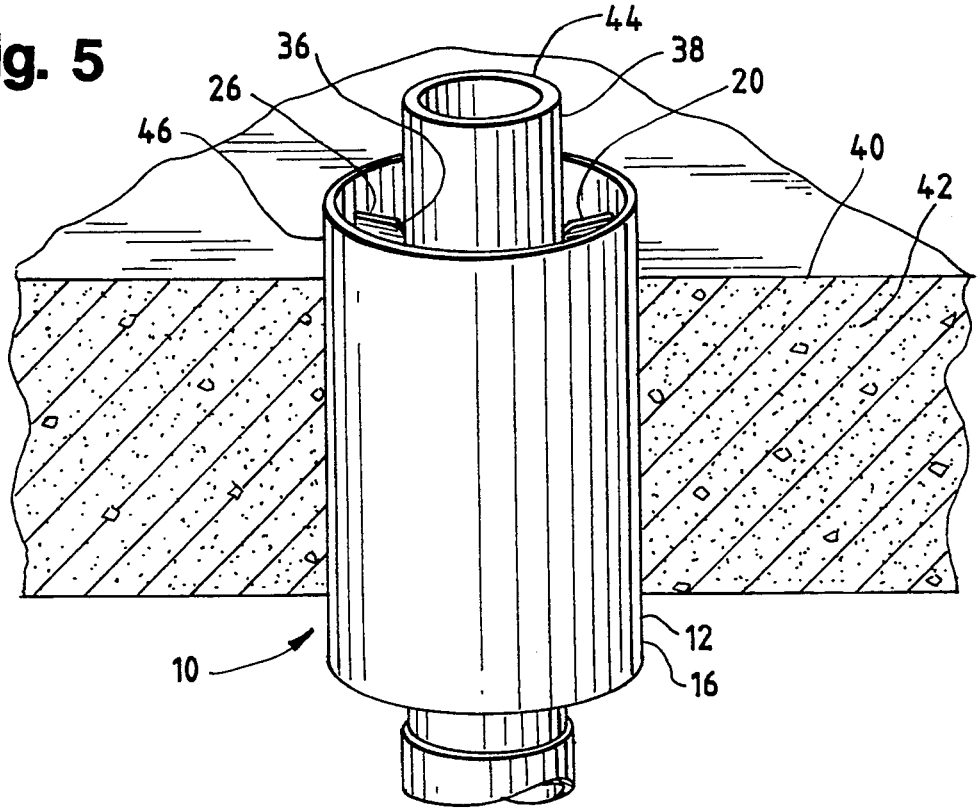
FIG. 5 is a perspective view of the reusable concrete spacer sleeve of FIG. 1 without the lid, shown fitted over a drain pipe extending above the level of the concrete floor.

FIG. 5 illustrates the reusable concrete spacer sleeve 10 of FIG. 1 without the lid 14, shown fitted over a drain pipe 38 extending above the concrete floor 42. As in FIG. 4, the sleeve 12 fits snugly around the pipe 38 and extends below the concrete floor 42. After the concrete 42 has set and the sleeve 12 has been removed, the pipe 38 may be cut off at a level below the concrete floor 42 and a flange installed.

The concrete spacer sleeve 10 may be used in the following manner. With reference to FIG. 4, after the vertical drain pipe 38 is installed and before the concrete 42 is poured, the drain pipe 38 is cut off up to about three to six inches below what will be the top 40 of the concrete floor 42. The spacer sleeve 12 is then slid onto the severed end 44 of the drain pipe 38 so that the top end 46 of the spacer sleeve 12 extends above what will be the top 40 of the concrete floor 42. Next, the concrete floor 42 is poured.

After the concrete floor 42 has been poured, the spacer sleeve 12 should extend above the top 40 of the concrete floor 42. The spacer sleeve 12 should be of such dimensions that, when it is removed, sufficient space is left between the drain pipe 38 and the concrete floor 42 to accommodate a flange. An adjustable (telescoping) closet flange such as that sold by J-tec Products Company of Grand Rapids, Mich. may be used.

After the spacer sleeve 12 is removed, the flange is placed into the hole left by the spacer sleeve 12 and over the severed end 44 of the drain pipe 38.

Alternatively, the drain pipe 38 may be cut off along a plane above what will be the top 40 of the concrete floor 42, as illustrated in FIG. 5. The spacer sleeve 12 is slid over the severed end 44 of the drain pipe 38 so that the top end 46 of the spacer sleeve 12 extends above what will be the top 40 of the concrete floor 42 when the floor is poured. The lid 14 is not used. Next, the concrete floor 42 is poured.

Again, the spacer sleeve 12 should be of such dimensions that, when it is removed, sufficient space is left between the drain pipe 38 and the concrete floor 42 to accommodate a flange.

After the spacer sleeve 12 is removed, the pipe 38 is cut along a plane below the top level 40 of the concrete floor 42. A flange (not shown) is placed into the hole left by the spacer sleeve 12 and over the newly severed end of the drain pipe 38.

Of course, many modifications and other embodiments of my invention will be recognized by one skilled in the art in view of the foregoing teachings. Therefore, the invention is not to be considered limited to the exact construction and operation described, and any suitable modifications are to be included within the scope of the claims allowed herein.

I claim as my invention:

1. For use in conjunction with a vertical drain pipe, a reusable concrete spacer sleeve comprising:

a substantially cylindrical body having an interior surface and an upper rim, the cylindrical body being open at the top and bottom; and substantially rectangular fins for positioning said cylindrical body about said pipe, said fins extending radially inwardly from the interior surface of the cylindrical body from one vertical edge of said fins, said fins having second vertical edges defining a substantially cylindrical space for accommodating the pipe in a snug fashion;

said substantially cylindrical body and fins being formed of a flexible thermoplastic material.

2. The concrete spacer sleeve of claim 1 further comprising a removable lid formed of flexible thermoplastic material for matingly engaging said upper rim of said cylindrical body.

3. For use in connection with a vertical drain pipe, a reusable concrete spacer sleeve comprising:

a substantially cylindrical body having an interior surface and an upper rim, the cylindrical body being open at the top and bottom;

a plurality of inwardly extending spacer elements evenly arranged about the interior surface of said body, each spacer element having a vertical edge and a top horizontal edge, said vertical edges defining a substantially cylindrical space for accommodating the pipe in a snug fashion; and a lid having a lip for matingly engaging said upper rim of said cylindrical body, said cylindrical body extending a sufficient distance above said spacer elements to accommodate said lid.

4. For use in connection with a vertical drain pipe, a reusable concrete spacer sleeve comprising:

a substantially cylindrical body having an interior surface and an upper rim, the cylindrical body being open at the top and bottom;

a plurality of inwardly extending spacer elements evenly arranged about the interior surface of said body, each spacer element having a vertical edge, a top horizontal edge and a notch located at the juncture of said vertical and horizontal edges, said vertical edges defining a substantially cylindrical space for accommodating the pipe in a snug fashion; and a lid having a lip for matingly engaging said upper rim of said cylindrical body, said cylindrical body extending a sufficient distance above said spacer elements to accommodate said lid;

said substantially cylindrical lid being formed of a flexible thermoplastic material.

5. The concrete spacer sleeve of claim 4 in which the spacer elements are fins.

* * * * *

UNITED STATES PATENT AND TRADEMARK OFFICE

CERTIFICATE OF CORRECTION

PATENT NO. : 5,347,786

DATED : September 20, 1994

INVENTOR(S) : B. Eugene Hodges

It is certified that error appears in the above-identified patent and that said Letters Patent is hereby corrected as shown below:

Column 4, line 52: after "cylindrical" insert --body, positioning means and--.

Signed and Sealed this

Fifteenth Day of November, 1994

Bruce Lehman

*Attest:*

BRUCE LEHMAN

*Attesting Officer*

*Commissioner of Patents and Trademarks*